US007192394B1

(12) United States Patent
Karl

(10) Patent No.: US 7,192,394 B1
(45) Date of Patent: Mar. 20, 2007

(54) AIR-COOLED CENTRIFUGE

(75) Inventor: Andreas Karl, Seeburg (DE)

(73) Assignee: Thermo Fisher Scientific Inc., Waltham, MA (US)

( * ) Notice: Subject to any disclaimer, the term of this patent is extended or adjusted under 35 U.S.C. 154(b) by 0 days.

(21) Appl. No.: 11/316,950

(22) Filed: Dec. 27, 2005

(51) Int. Cl.
*B04B 15/02* (2006.01)
*B04B 5/02* (2006.01)

(52) U.S. Cl. ..... 494/14; 494/60

(58) Field of Classification Search ..... 494/13–14, 494/16–21, 23, 25–26, 60; 210/175, 180; 422/72
See application file for complete search history.

(56) References Cited

U.S. PATENT DOCUMENTS

| | | | | |
|---|---|---|---|---|
| 2,699,289 | A * | 1/1955 | Allen et al. | 494/16 |
| 2,778,566 | A * | 1/1957 | Garrett | 494/13 |
| 2,878,992 | A * | 3/1959 | Pickels et al. | 494/14 |
| 2,917,229 | A * | 12/1959 | Di Benedetto et al. | 494/14 |
| 3,148,146 | A * | 9/1964 | Asnes et al. | 494/1 |
| 3,860,166 | A * | 1/1975 | Anderson | 494/13 |
| 4,053,104 | A * | 10/1977 | Penhasi et al. | 494/14 |
| 4,193,536 | A * | 3/1980 | Kubota | 494/14 |
| 4,221,325 | A * | 9/1980 | Kubota | 494/14 |
| 5,490,830 | A * | 2/1996 | Lovelady et al. | 494/14 |
| 5,724,819 | A * | 3/1998 | Boeckel et al. | 62/3.7 |
| 5,772,572 | A | 6/1998 | Koch et al. | |
| 2005/0043163 | A1* | 2/2005 | Malugvist et al. | 494/14 |
| 2006/0142134 | A1* | 6/2006 | Andersson et al. | 494/14 |

FOREIGN PATENT DOCUMENTS

| | | | |
|---|---|---|---|
| DE | 2611679 A1 * | 9/1977 | |
| DE | 0455876 A2 * | 11/1991 | |
| DE | 196 15 702 | 10/1997 | |
| DE | 10017318 A1 * | 10/2001 | |
| DE | 10316897 A1 * | 11/2004 | |
| DE | 102004052847 A1 * | 6/2006 | |
| JP | 54-117975 * | 9/1979 | |
| JP | 61-13161 * | 1/1986 | |
| JP | 10-85627 * | 4/1998 | |
| JP | 2000-93847 * | 4/2000 | |
| JP | 2000-107642 * | 4/2000 | |
| JP | 2003-275621 * | 9/2003 | |
| JP | 2005-230749 * | 9/2005 | |
| WO | 2004/045774 A1 * | 6/2004 | |

* cited by examiner

*Primary Examiner*—Charles E. Cooley
(74) *Attorney, Agent, or Firm*—Baker & Hostetler LLP

(57) ABSTRACT

The present invention relates to an air-cooled centrifuge comprising a rotor driven around a rotation axis by a motor and a cooling channel, which surrounds one wall of the rotor, wherein the cooling channel is provided for the air transportable in the cooling channel with an outlet opening, through which air can flow out from the centrifuge, and the outlet opening comprises a first wall, which starts at the outer periphery of the cooling channel and continues in such a way that it has an increasing distance from the rotation axis of the rotor with the simultaneously increasing rotation angle around the rotation axis of the rotor, wherein the outlet opening comprises a second wall, which starts at the outer periphery of the cooling channel and continues in such a way that it has an increasing distance from the rotation axis of the rotor with the simultaneously increasing rotation angle around the rotation axis of the rotor, so that the second wall extends as a straight line or has a curved contour, whose centers of curvature are turned away from the outlet opening.

12 Claims, 7 Drawing Sheets

AIR-COOLED CENTRIFUGE

FIELD OF THE INVENTION

The present invention relates to an air-cooled centrifuge comprising a rotor driven around a rotation axis by means of a motor and a cooling channel, which surrounds one wall of the rotor, wherein the cooling channel is provided for the air transported in the cooling channel with an outlet opening, through which air can flow out from the centrifuge, and the outlet opening comprises a first wall, which starts at the outer periphery of the cooling channel and continues in such a way that it has an increasing distance from the rotation axis of the rotor with the simultaneously increasing rotation angle around the rotation axis of the rotor.

BACKGROUND OF THE INVENTION

According to prior art, see e.g. DE 196 15 702, micro liter centrifuges are known, using which samples, which are held in a rotor driven by a motor, can be centrifuged. Below this rotor, air is sucked in and guided to the rotor outer wall so that the rotor outer wall and the samples contained in the rotor are cooled by the flow of the air. After a heat exchange, which thus takes place with the rotor surface and/or the samples located in the rotor, the air escapes from an outlet opening, which is arranged above the rotor.

The outlet opening is provided with a wall, on which a part of the air particles can impinge frontally. This results in front of such a wall in a whirl zone and/or a zone having a no longer linearly directed flow and relatively high pressure in comparison with a zone which is at a further distance from the wall. This whirl zone can cover a relatively large area, as a result of which the actually effective outlet opening, along which the cold air can escape from the centrifuge, is reduced.

In a region above the rotor and in the vicinity of the wall on which the air particles impinge, a displacement body is additionally arranged according to prior art, wherein said displacement body is supposed to prevent air particles, which are on their way to the outlet opening from being dragged along again by the rotor flow into an air channel, which surrounds the rotor. Due to the displacement body, the area of the whirl zone in the transmission region between the air channel and the wall of the outlet opening is increased. This can sometimes lead to a reduction in the heat dissipation from the centrifuge.

Against this background, the object of the invention is to optimize the air transport around the rotor and out of the centrifuge in the generic centrifuge with the best possible heat dissipation.

SUMMARY OF THE INVENTION

According to the invention, this object is achieved by providing an air-cooled centrifuge, which comprises a rotor driven around a rotation axis by means of a motor and a cooling channel, which surrounds one wall of the rotor, wherein the cooling channel is provided for the air transportable in the cooling channel with an outlet opening through which air can flow out of the centrifuge, and the outlet opening comprises a first wall, which starts at the outer periphery of the cooling channel and continues in such a way that it has an increasing distance from the rotation axis of the rotor with a simultaneously increasing rotation angle around the rotation axis of the rotor, wherein the outlet opening comprises a second wall, which starts at the outer periphery of the cooling channel and continues in such a way that it has an increasing distance from the rotation axis of the rotor with a simultaneously increasing rotation angle around the rotation axis of the rotor, so that the second wall extends as a straight line or has a curved contour whose centers of curvature are turned away from the outlet opening.

This is advantageous since the escaping air particles are guided along their "natural" flight path. A whirl zone or a high-pressure zone, which occurs due to the frontal impact of air particles on a wall of the outlet opening, is thus effectively avoided. The flow resistance of the air particles guided in this manner is thus relatively low, so that the heated air can be dissipated efficiently from the centrifuge. An especially good cooling of the rotor and the samples contained therein is thus achieved. Since there are no more distinct whirl zones and high-pressure zones, the actually effective passage area of the outlet opening is not reduced. In addition to the very efficient passive cooling of the sample product, a very good running smoothness is also achieved due to the absence of whirl zones and high-pressure zones.

In a preferred embodiment of the invention, the cross-section of the outlet opening expands increasingly towards the outflowing air and starting from the outer periphery of the cooling channel. Thus, the outflowing air particles are not opposed by any resistance, so that no pressure zones or whirl zones can occur.

In a preferred embodiment of the invention, the second wall extends essentially in the shape of a section of a spiral, wherein it is especially preferred if the initial point of the spiral forming the progression of the second wall is arranged in the rotation axis of the rotor. Since the air particles are spirally accelerated from their inlet region below the rotor up to the outer wall of the rotor, they can leave the outlet opening in this embodiment spirally starting from the rotation axis of the rotor. A thus designed wall of the outlet opening indicates the flight path of the air particles well.

In a preferred embodiment of the invention, the first wall has a curved contour, whose centers of curvature are turned towards the outlet opening. It is thus feasible, that the outflowing air particles do not arrive into a low-pressure zone, which occurs in case of a curved contour having centers of curvature, which are turned away from the outlet opening. Due to the curved contour, the width of the air outlet from the centrifuge can be additionally reduced.

According to another embodiment of the invention, the first wall extends essentially in the shape of a section of a spiral, wherein preferably the initial point of the spiral forming the progression of the first wall, is arranged in the rotation axis of the rotor. It is thus possible to achieve a contour that is well adapted to the flight path of the air particles.

According to another embodiment of the invention, the outlet opening has a width vertically to the air passing the outlet opening, said width being adjustable. If the outlet opening has a relatively small width, only a small quantity of air leaves the cooling channel. Thus it is possible to achieve a heat exchange between the air and the rotor surface for a relatively long time. In case of a larger width of the outlet opening, a relatively large airflow leaves the outlet opening, so that a high airflow rate can be achieved. Due to an adjustable width of the outlet opening, the cooling capacity of the centrifuge can thus be influenced distinctly. The width of the outlet opening can be adjusted depending on the temperature of the circulating air or it can be adjusted by means of an additional mechanism.

In another embodiment of the invention, the width of the outlet opening is at most the width of the centrifuge. The pressure difference between the cooling channel and the end of the outlet opening increases with an increasing width of the outlet opening. This can lead to greater noise emission.

According to another embodiment of the invention, the outlet opening is provided above a top edge of the rotor. What is achieved by this is that, the air circulating around the rotor is in contact with the rotor for the longest possible duration and can absorb heat. If the outlet opening is arranged above the top edge of the rotor, the air will leave the centrifuge only when a relatively large heat exchange has taken place.

According to another embodiment of the invention, the outlet opening is bordered by a cover. Thus there is no outlet slot, which is provided by four sides with a wall. The outlet opening is thus defined distinctly so that an accurately directed airflow from the centrifuge is achieved.

According to another embodiment of the invention, the air close to the rotation axis of the rotor can be fed into the channel. This is advantageous since air particles can thus be accelerated spirally in the channel so that an air column occurs that rotates along with it. A relatively high heat exchange with the rotor outer surface and/or the samples contained in the rotor is thus ensured.

BRIEF DESCRIPTION OF THE INVENTION

In the following description the invention is explained on the basis of preferred embodiments with reference to the drawing, of which:

DETAILED DESCRIPTION OF THE INVENTION

Figure 1:
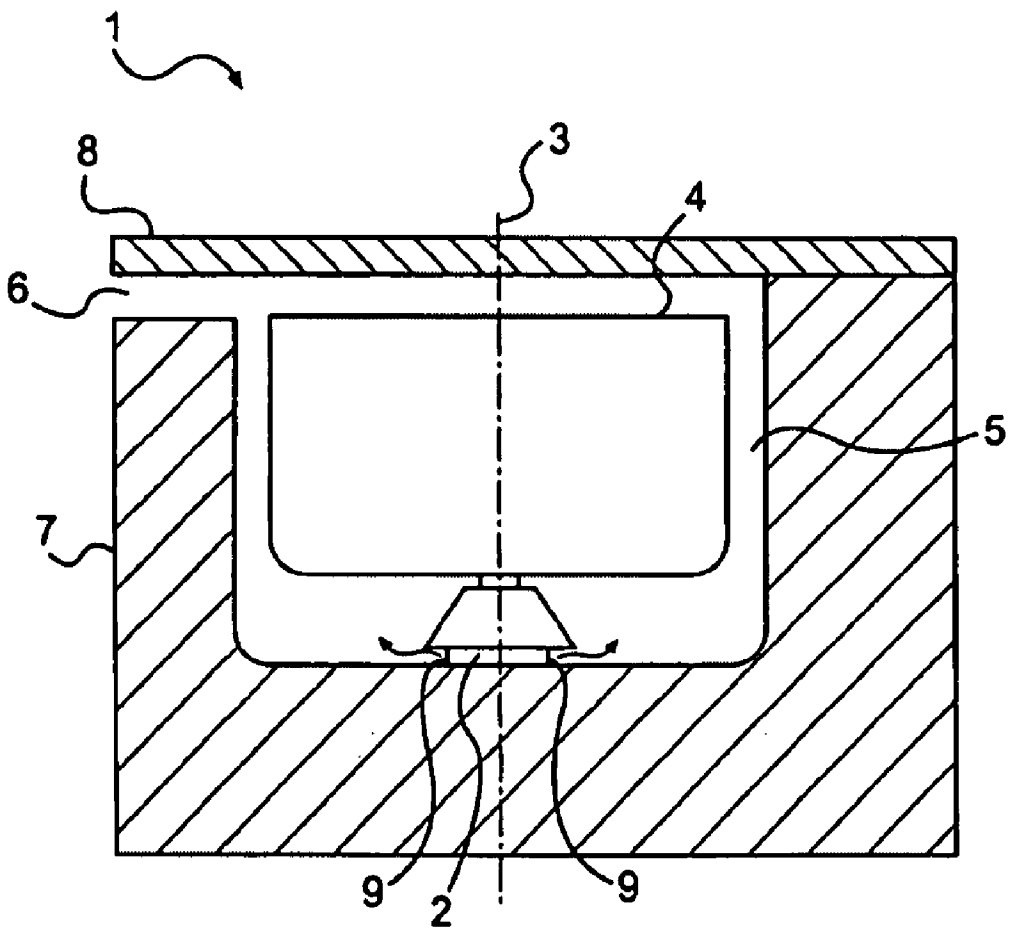
FIG. 1 illustrates schematically the side view of a cross-section of an embodiment of an air-cooled centrifuge according to the invention.

FIG. 1 illustrates schematically the side view of the cross-section of an embodiment of the centrifuge according to the invention. The centrifuge 1 comprises a drive motor 2 having a rotation axis 3, wherein the drive motor 2 drives a rotor 4. In the rotor 4 samples (not illustrated) are provided, which are centrifuged at a corresponding number of revolutions of the drive motor 2. The rotor 4 and a part of the motor 2 are surrounded by a cooling channel 5, in which air is transported. The air arrives through an inlet opening 9, which is close to the rotation axis 3 of the drive motor 2, into the cooling channel 5 and is accelerated along by the rotation of the rotor until it escapes from the centrifuge through an outlet opening 6. Between the rotor 4 and the cooling channel 5 a housing 7 is provided, which is closed with a housing cover 8 in such a way that air is guided out of the cooling channel not freely upwards, but exclusively through the outlet opening 6.

Figure 2:
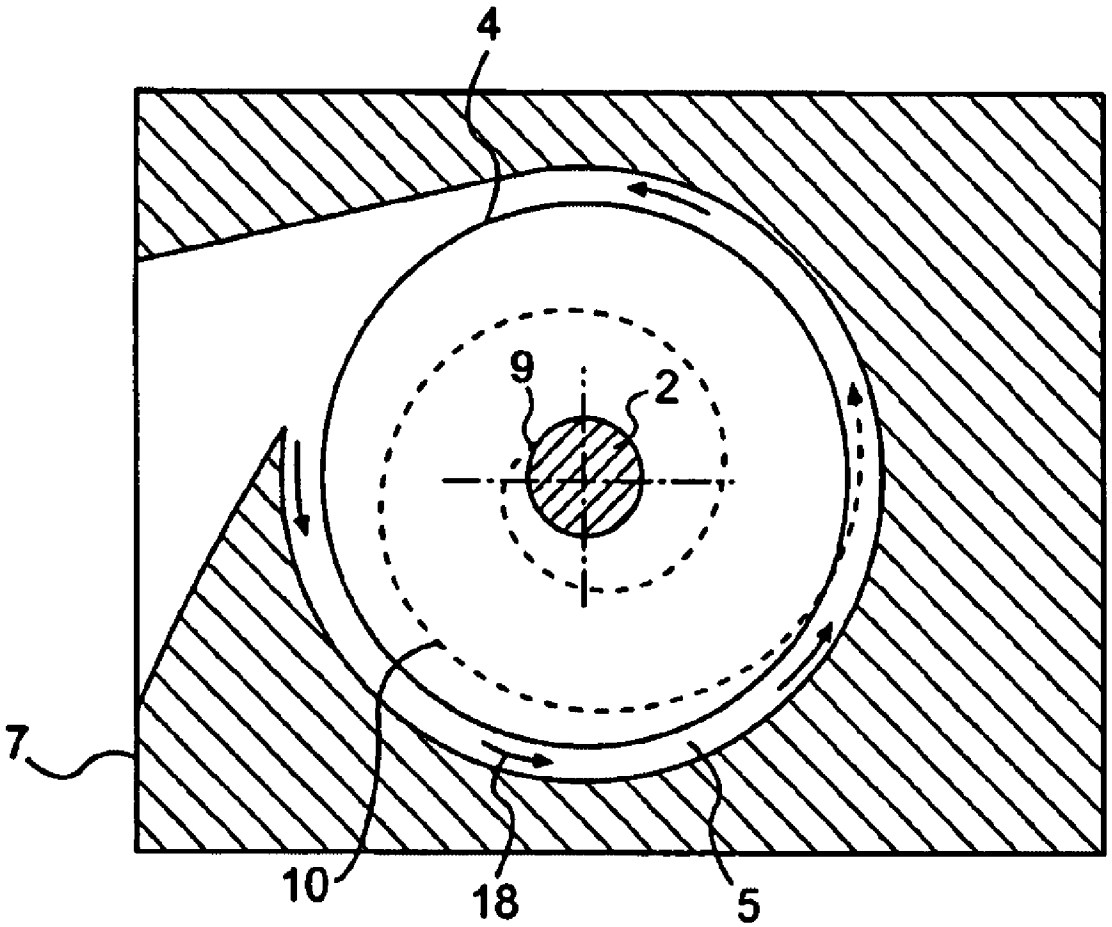
FIG. 2 illustrates schematically the top view of the cross-section of an embodiment of the centrifuge according to the invention, wherein spiral movement paths of the air particles are illustrated.

If air enters into the cooling channel through one or more inlet openings 9 (e.g. by suction), it arrives on the rotor surface and is accelerated along by friction on the rotor surface in case of a rotating rotor. This results in an air column, in which the air particles are moved from the inlet opening 9 close to the rotation axis 3 of the drive motor 2 spirally outwards towards the outer wall of the cooling channel 5. FIG. 2 illustrates such a movement spiral 10 of the air particles.

In the cooling channel 5 the air circulates and carries out in interaction with the rotor surface a heat exchange, during which the heat from the rotor and/or the samples contained in the rotor is transmitted to the air. If the air has absorbed a sufficient quantity of heat, so that it can no longer cool the rotor and/or the samples contained therein, it is supposed to escape from the centrifuge. For this purpose, an outlet opening 6 is provided above the top edge of the rotor 4 in the embodiment illustrated in FIG. 1.

Figure 3:
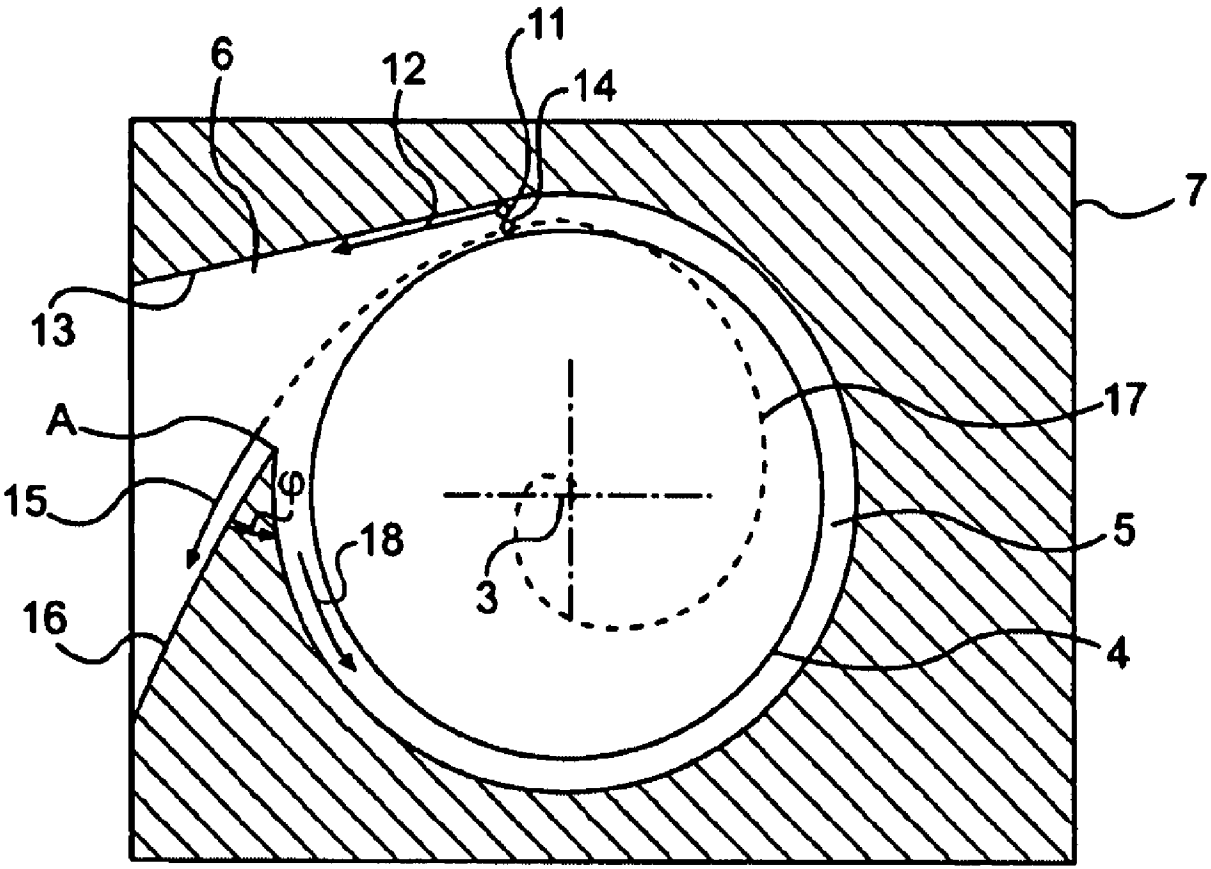
FIG. 3 illustrates schematically the top view of an embodiment of the centrifuge according to the invention with movement paths of air particles.

Should air particles come into the region of the outlet opening, they are no longer held on a circular path by the wall of the cooling channel 5. In FIG. 3 an air particle 11 in the outer peripheral zone of the cooling channel 5 is illustrated. The first wall 13 of the outlet opening 6 is thereby designed in such a way that the air particle 11, when leaving the peripheral zone of the cooling channel 5, need not overcome any more resistance by a device or a high-pressure zone or low-pressure zone. The air particle leaves the peripheral zone of the cooling channel 5 tangentially to the circular path of the cooling channel, see arrow 12 in FIG. 3.

An air particle 14 in the bottom peripheral zone of the cooling channel 5, see FIG. 3, is influenced in its path by the movement of the air particle 11, which is at a distance from the cooling channel. A relative vacuum is formed above the air particle 14 so that the air particle 14 can take up a larger path radius. The air particle 14 can then circulate again along a path curve 18 in the cooling channel 5. If, however, the air particle 14 has attained a path radius which is larger than the outer diameter of the air channel 5, it leaves the cooling channel 5 and enters into the outlet opening 6. The path of the air particle 14 can be spiral in this case, wherein in the outlet opening 6 the flight path is indicated by the arrow 15. In the embodiment illustrated in FIG. 3 the second wall 16 of the outlet opening 6 is designed in such a way that it extends equidistantly from the flight path 15.

The particles streaking past along the second wall 16 are thus guided exactly along their flight path. The result is a relatively low flow resistance, less whirl formation and low noise emission. In another embodiment of the invention the progression of the second wall 16 can be designed in such a way that it assumes the shape of a straight line (see the dashed line in FIG. 4). It can, for example, be designed as a tangent to the outer periphery of the cooling channel.

Figure 7:
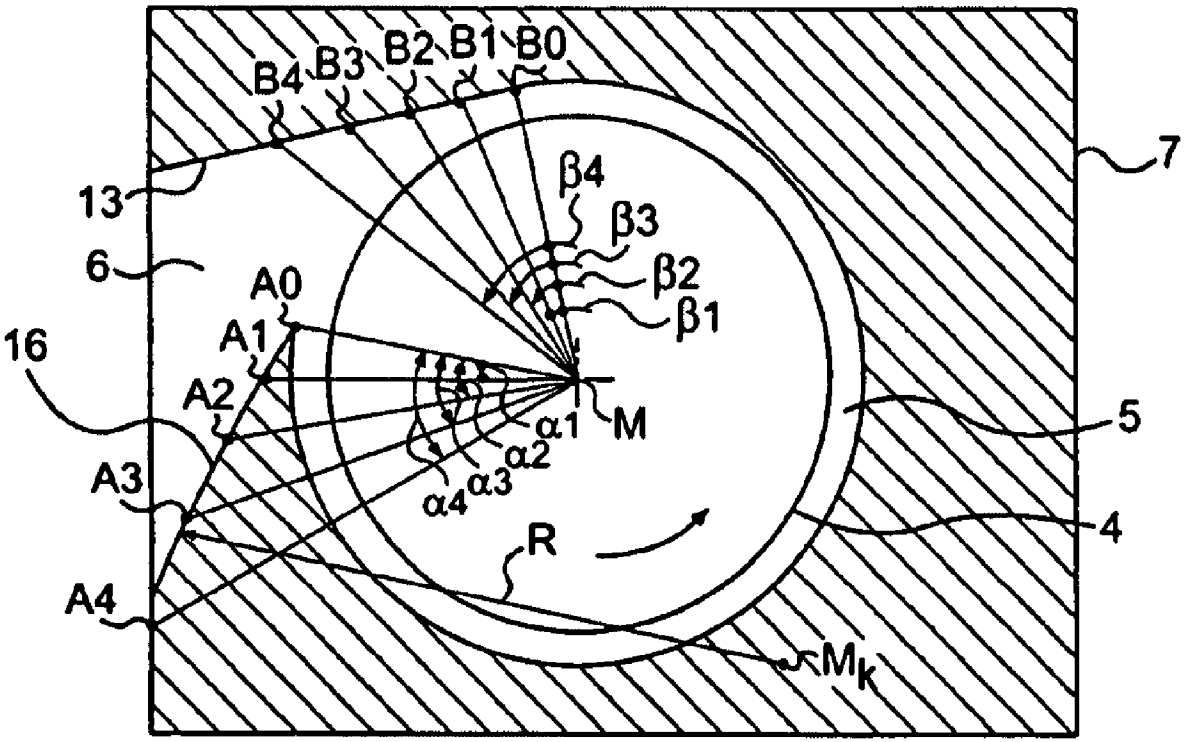
FIG. 7 is the schematic illustration for explaining the design of the first wall and the second wall.

In the following the design of the progression of the second wall 16 according to the invention is explained with reference to FIG. 7. If a point M arranged in the rotation axis 3 is connected to a point A0, which is arranged on the outer periphery of the cooling channel and represents the start of the second wall, then a connecting passage MAO results in the top view of the centrifuge. If starting from this passage an adjoining passage is plotted in the rotation direction of the rotor 4 (counterclockwise direction in FIG. 7) around the rotation axis 3 and/or the point M at an angle $\alpha$1, and if this adjoining passage has a larger length than the passage MA0, the result is a passage MA1. If in this way the design of a passage MA2 at an angle $\alpha 2$ to the passage MA0, a passage MA3 at an angle $\alpha 3$ to the passage MA0 and a passage MA4 at an angle $\alpha 4$ to the stretch MA0 is continued, see FIG. 7, wherein:

$$\alpha 1<\alpha 2<\alpha 3<\alpha 4$$

applies for the angles and $$\overline{MA0}<\overline{MA1}<\overline{MA2}<\overline{MA3}<\overline{MA4}$$

applies for the associated passage lengths, then the result is the contour of the second wall 16. This second wall 16 can thereby extend in the shape of a straight line, as illustrated by the dashed line in FIG. 4. However, it can also extend in a curved manner, as is evident in FIG. 7. In case of a curved contour of the second wall 16, an associated center of curvature $M_K$ can be specified in the region between the start A0 of the contour and the end A4 of the contour to every point of the contour, see FIG. 7. The curvature of the contour is thereby oriented in such a way that each center of curvature $M_K$ is turned away from the outlet opening 6. In the embodiment illustrated in FIG. 7 the contour of the second wall can be described more closely as a segment of a circle, so that it is possible to specify a common center of curvature $M_K$ having an associated radius R for the contour. Seen from the rotor rotation axis 3, the contour of the second wall 16 is provided with a convex design.

The design of the second wall 16 can basically also be transferred to the design of the first wall 13. The associated points B0, B1, B2, B3 and B4 for the angles $\beta 1$, $\beta 2$, $\beta 3$ and $\beta 4$ are plotted in FIG. 7. The first wall 13 extends as a straight line in this embodiment.

Figure 4:
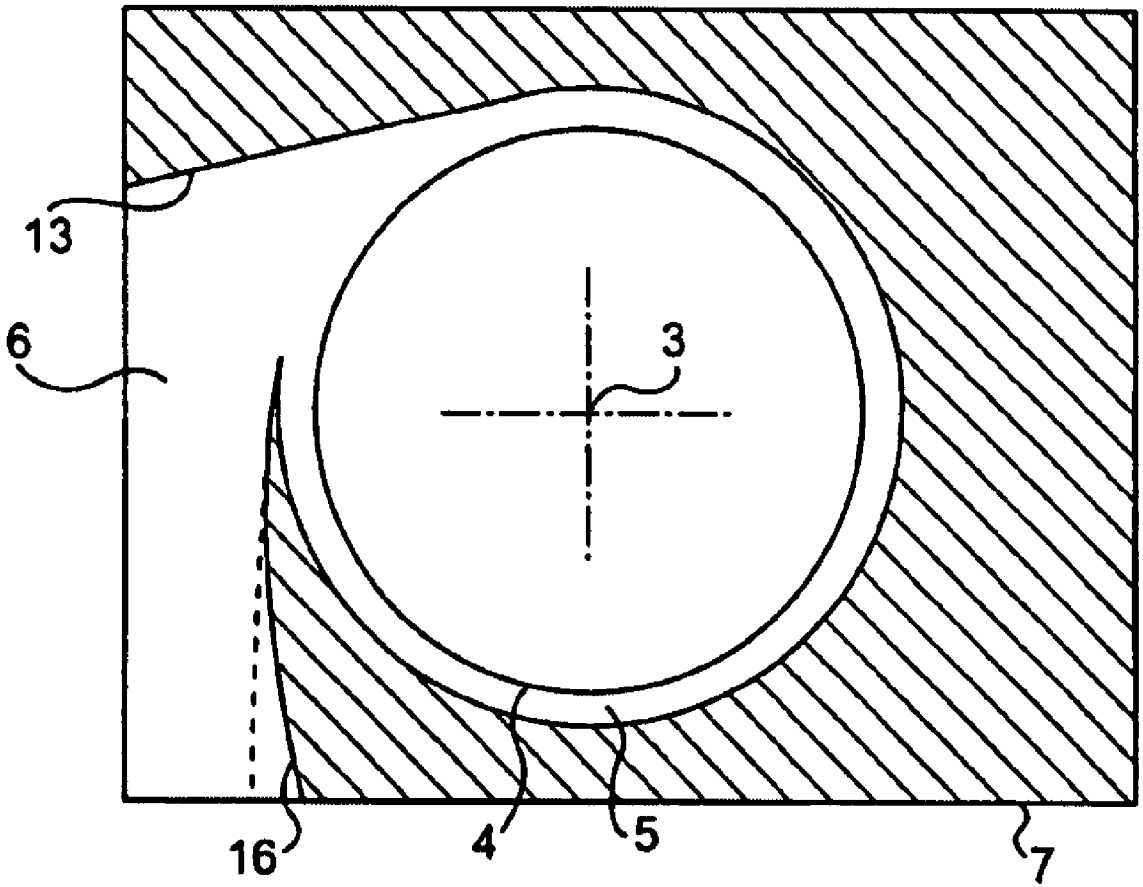
FIG. 4 illustrates schematically the top view of another embodiment of the centrifuge according to the invention.

One parameter for the variation in the design of the second wall 16 can be the shape of the region A of the second wall 16, see FIG. 3. The region A of the wall 16 represents the transition region between the outer diameter of the cooling channel 5 and the start of the outlet opening 6. In this location, small pressure changes can occur, which influence the path of the air particles. One parameter is, e.g. the angle $\phi$ between the start of the outlet opening 6 and the outer wall of the cooling channel 5. Another influencing variable for the flight path 15 of an air particle streaking along the second wall 16 is the geometric shape of the region A of the second wall 16. Not only pointed geometries, as illustrated in FIGS. 3 and 4, but rounded or circular arc-shaped geometries are also feasible. A possible progression of a spiral belonging to the wall 16 of the outlet opening 6 is marked with the reference numeral 17.

Figure 5:
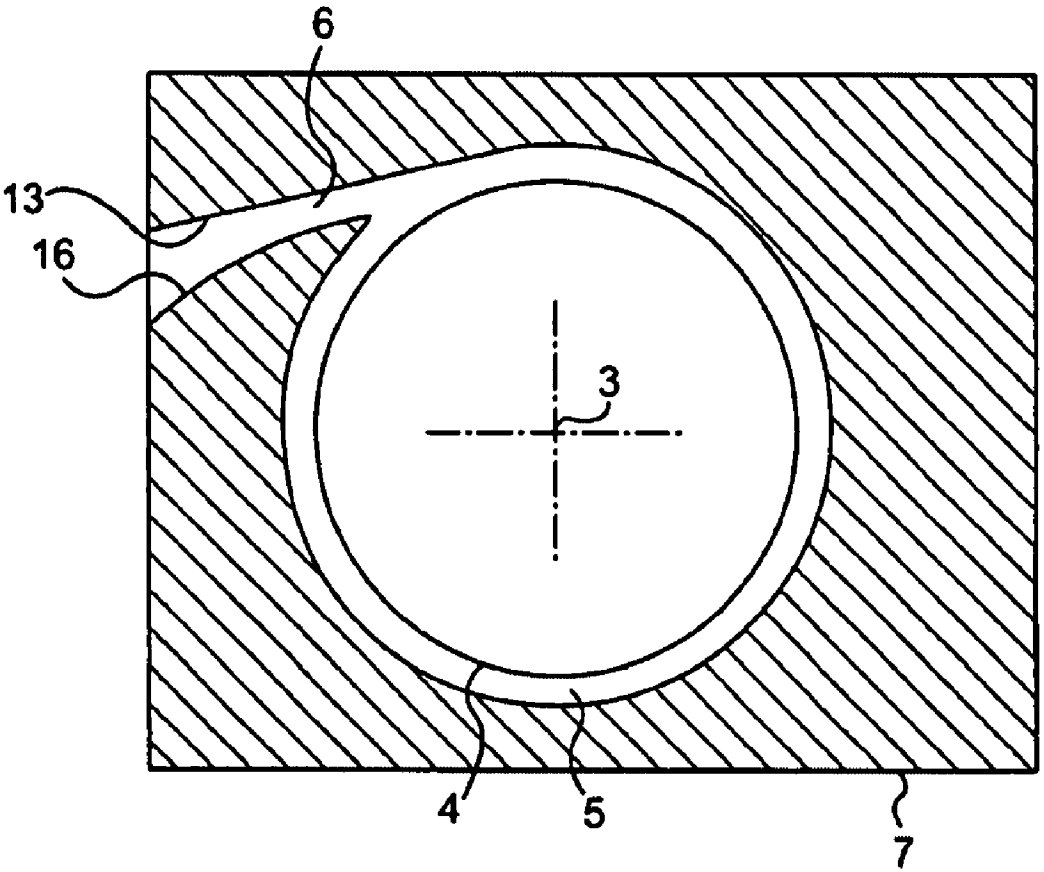
FIG. 5 illustrates schematically the top view of another embodiment of the centrifuge according to the invention.

FIG. 4 illustrates another embodiment of the centrifuge according to the present invention. The outlet opening 6 comprises a first wall 13 and a second wall 16, wherein on the location A the second wall 16 tangentially continues the outer wall of the cooling channel 5. In the embodiment illustrated in FIG. 4, the outlet opening 6 is designed to be larger than in the embodiment illustrated in FIG. 3. However, it can also be designed to be distinctly smaller, see FIG. 5. Depending on the size of the outlet opening 6, a variable quantity of cold air is released from the cooling channel 5. It is advantageous if the position of the second wall 16 is adjustable. Thereby this can take place either manually or using a motor, so that, for example, in case of still relatively cold cooling air, which can absorb a relatively large amount of heat, a smaller outlet opening is present than in case of already distinctly heated cooling air, which is supposed to be conveyed outwards in greater quantities.

Figure 6:
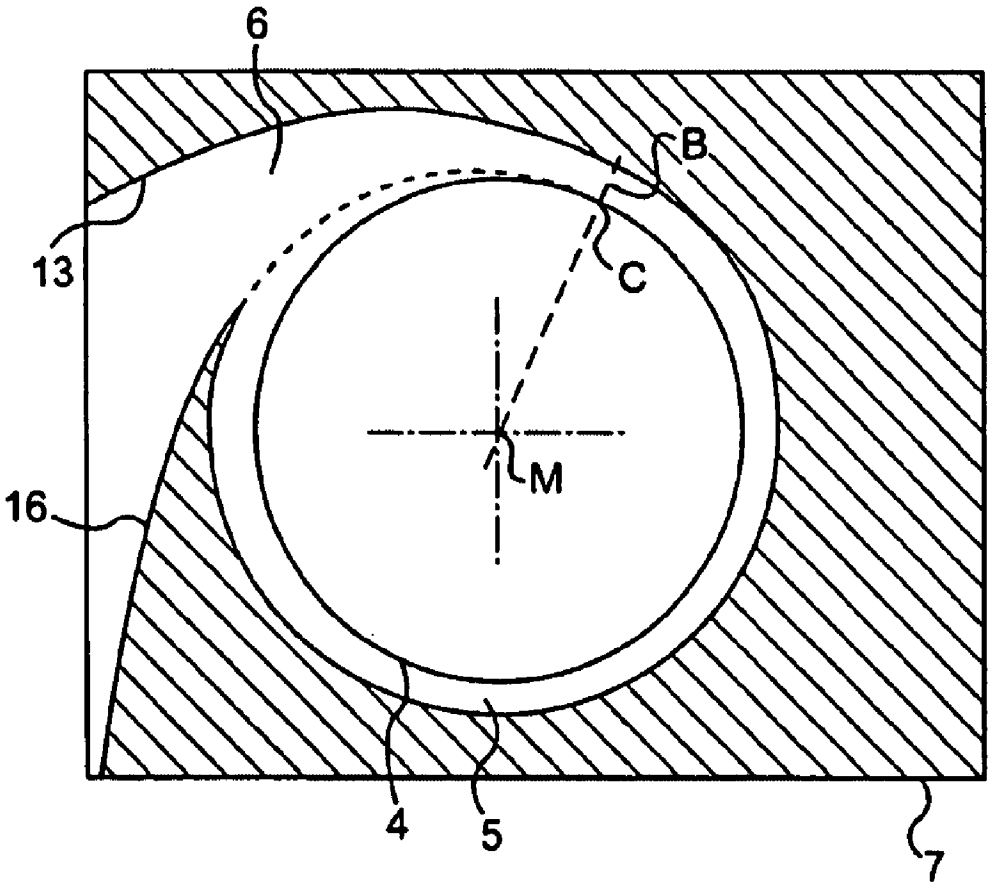
FIG. 6 illustrates schematically the top view of another embodiment of the centrifuge according to the invention.

FIG. 6 is the schematic sectional illustration of a top view of another embodiment of the centrifuge according to the invention. The outlet opening 6 is thereby bordered by the first wall 13 and the second wall 16, wherein the first wall 13 as well as the second wall 16 are designed in the shape of a section of a spiral. The continuation of the second wall 16 extends in such a way that point C forms an intersection point with the inner edge of the cooling channel 5, wherein point C lies on a connecting line between the rotation axis of the rotor with the center M and the intersection point B of the first wall 13 with the outer edge of the cooling channel 5, see FIG. 6. Nevertheless, it is also possible that the point C lies outside the connecting line MB. The centers of curvature belonging to the first wall are turned towards the outlet opening 6.

The invention claimed is:

1. An air-cooled centrifuge comprising a rotor driven around a rotation axis by means of a motor and a cooling channel, which surrounds one wall of the rotor, wherein the cooling channel for the air transportable in the cooling channel is provided with an outlet opening, through which air can flow out from the centrifuge, and the outlet opening comprises a first wall, which starts at the outer periphery of the cooling channel and continues in such a way that it has an increasing distance from the rotation axis of the rotor with the simultaneously increasing rotation angle around the rotation axis of the rotor, wherein the outlet opening comprises a second wall, which starts at the outer periphery of the cooling channel and continues in such a way that it has an increasing distance from the rotation axis of the rotor with the simultaneously increasing rotation angle around the rotation axis of the rotor, so that the second wall extends as a straight line or has a curved contour, whose centers of curvature ($M_K$) are turned away from the outlet opening.

2. The centrifuge according to claim 1, wherein the cross-section of the outlet opening expands increasingly starting from the outer periphery of the cooling channel towards the outflowing air.

3. The centrifuge according to claim 1, wherein the second wall extends essentially in the shape of a section of a spiral.

4. The centrifuge according to claim 3, wherein the initial point of the spiral forming the progression of the second wall is arranged in the rotation axis of the rotor.

5. The centrifuge according to claim 1, wherein the first wall has a curved contour, whose centers of curvature are turned towards the outlet opening.

6. The centrifuge according to claim 1, wherein the first wall extends essentially in the shape of a section of a spiral.

7. The centrifuge according to claim 6, wherein the initial point of the spiral forming the progression of the first wall is arranged in the rotation axis of the rotor.

8. The centrifuge according to claim 1, wherein the outlet opening has a width vertically to the air flowing through the outlet opening, said width being adjustable.

9. The centrifuge according to claim 1, wherein the width of the outlet opening is at most the width of the centrifuge.

10. The centrifuge according to claim 1, wherein the outlet opening is provided above a top edge of the rotor.

11. The centrifuge according to claim 1, wherein the outlet opening is bordered by a cover.

12. The centrifuge according to claim 1, wherein the air close to the rotation axis of the rotor can be fed into the cooling channel.

* * * * *

UNITED STATES PATENT AND TRADEMARK OFFICE

CERTIFICATE OF CORRECTION

PATENT NO. : 7,192,394 B1
APPLICATION NO. : 11/316950
DATED : March 20, 2007
INVENTOR(S) : Andreas Karl It is certified that error appears in the above-identified patent and that said Letters Patent is hereby corrected as shown below:

On the Title Page under FOREIGN PATENT DOCUMENTS, DE 102004052847 A1* 6/2006 should read

DE 102004058247 A1 * 6/2006

Signed and Sealed this

Fourteenth Day of October, 2008

JON W. DUDAS
*Director of the United States Patent and Trademark Office*